US005169306A

United States Patent [19]

Nakagaito

[11] Patent Number: 5,169,306

[45] Date of Patent: Dec. 8, 1992

[54] MULTI-CYLINDER COMBUSTION STRUCTURE FOR OIL BURNER

[75] Inventor: Toru Nakagaito, Aichi, Japan

[73] Assignee: Toyotomi Co., Ltd., Aichi, Japan

[21] Appl. No.: 677,473

[22] Filed: Mar. 29, 1991

Related U.S. Application Data

[63] Continuation-in-part of Ser. No. 427,405, Oct. 27, 1989, Pat. No. 5,087,195.

[30] Foreign Application Priority Data

Mar. 30, 1990 [JP] Japan ..... 2-85964

[51] Int. Cl.[5] ..... F23D 3/02

[52] U.S. Cl. ..... 431/302; 431/309; 431/298; 431/310; 126/96

[58] Field of Search ..... 431/302, 303, 309, 298, 431/310; 126/95-97

[56] References Cited

U.S. PATENT DOCUMENTS

| | | | |
|---|---|---|---|
| 4,390,003 | 6/1983 | Nakamura et al. | 431/309 X |
| 4,465,457 | 8/1984 | Ishikawa et al. | 431/309 X |
| 4,569,652 | 2/1986 | Nakamura et al. | 431/309 X |
| 4,626,197 | 12/1986 | Kumazawa et al. | 431/302 |
| 4,790,746 | 12/1988 | Uno et al. | 431/302 X |
| 5,087,195 | 2/1992 | Nakanishi et al. | |

FOREIGN PATENT DOCUMENTS

| | | | |
|---|---|---|---|
| 220446 | 5/1987 | European Pat. Off. | 431/302 |
| 32174 | of 1972 | Japan . | |
| 35707 | of 1972 | Japan . | |
| 24347 | of 1979 | Japan . | |
| 48808 | 8/1988 | Japan | 431/302 |
| 3577 | of 1995 | Japan . | |

*Primary Examiner*—Larry Jones

*Attorney, Agent, or Firm*—Pollock, Vande Sande & Priddy

[57] ABSTRACT

A multi-cylinder combustion structure for an oil burner capable of permitting a red-heated section of a double combustion cylinder to be uniformly red-heated while ensuring complete combustion irrespective of the amount of combustion, to thereby exhibit satisfactory aesthetic and handling characteristics. The structure includes a central cylinder which is provided with a plurality of circumferentially-extending strip-like perforated sections and a plurality of circumferentially-extending strip-like non-perforated sections in a manner to vertically alternate with one another. Therefore, even when the wick is lowered to decrease the amount of combustion to a degree sufficient to cause the upper end of a combustion flame to be positioned in the gap of the double combustion cylinder, the upper portion of a red-heated section of the double combustion cylinder is rendered uniformly dark and the lower portion thereof is rendered uniformly red-heated while ensuring that the boundary between both portions is circumferentially uniformly defined.

10 Claims, 2 Drawing Sheets

MULTI-CYLINDER COMBUSTION STRUCTURE FOR OIL BURNER

RELATED APPLICATIONS

This is a continuation-in-part of prior application Ser. No. 07/427,405 filed Oct. 27, 1989, now U.S. Pat. No. 5,087,195.

BACKGROUND OF THE INVENTION

This invention relates to a multi-cylinder combustion structure for an oil burner, and more particularly to a multi-cylinder combustion structure for an oil burner which is adapted to be red-heated to outward emit heat-rays for heating a room or space.

An oil burner of the combustion cylinder structure type which is adapted to heat a room or space by means of heat rays emitted from a combustion cylinder structure red heated by combustion of fuel oil therein is so constructed that the combustion cylinder structure is directly observed, unlike an oil burner of the hot air discharge type which is adapted to heat a room or space by means of hot air discharged from the oil burner; thus, it is required to satisfactorily exhibit an aesthetic effect as well as a heat emission function. For an oil burner of the combustion cylinder structure type, there has been widely used a multi-cylinder combustion structure which includes inner and outer cylindrical members concentrically arranged so as to be spaced from each other at a suitable distance and red-heated by combustion of fuel oil therein and a heat-permeable cylinder arranged outside the outer cylindrical member so as to permit heat rays emitted from the red-heated inner and outer cylindrical members to be outward discharged therethrough for heating a space. The so-constructed multi-cylinder combustion structure was improved so as to carry out complete combustion of fuel oil, even when a wick is lowered to reduce the amount of combustion to a degree sufficient to cause the upper end of a combustion flame formed by combustion of fuel oil to be positioned in a gap between the inner cylindrical member and the outer cylindrical member. This is accomplished by arranging a central cylinder inside the inner cylindrical member. Unfortunately, the multi-cylinder combustion structure fails to keep the cylindrical members, particularly, the outer cylindrical member satisfactorily red-heated when the wick is thus lowered to cause the upper end of a combustion flame to be positioned in the gap between both cylindrical members, because the portion of the outer cylindrical member which the combustion flame does not reach is observed to be dark and the dark portion is positionally irregular in the circumferential direction of the outer cylindrical member. Such phenomenon causes a user often to misunderstand that the structure carries out incomplete combustion, although complete combustion actually takes place in the structure.

A combustion cylinder construction which has been conventionally used for an oil-fired cooking stove is constructed so as to be accommodated to a wide variation in combustion. More specifically, it is generally constructed in such a manner that a central cylinder is arranged inside an inner cylindrical member to separate the flow of air directed to the lower portion of the inner cylindrical member from that directed to the upper portion thereof, resulting in air in a gap between the inner cylindrical member and the central cylinder being controlled so as to be fed via small through-holes of the inner cylindrical member to a gap between the inner cylindrical member and an outer cylindrical member. Such construction permits complete combustion to be accomplished even when the upper end of a combustion flame is positioned in the gap between the outer cylindrical member and the inner cylindrical member to to reduce the amount of combustion.

Such construction is utilized for the above-described multi-cylinder combustion structure for heating a space or room, to thereby permit complete combustion to be attained even when the amount of combustion is kept at a decreased level.

More particularly, in the multi-cylinder combustion structure free of such a central cylinder as described above, when the combustion operation is carried out while positioning the upper end of a combustion flame in the gap between the inner cylindrical member and the outer cylindrical member to keep combustion reduced, fuel oil of a high molecular weight vaporized from a wick is thermally decomposed into combustible gas of low molecular weights by combustion heat at a portion of the gap in which the combustion flame exists, to thereby cause the volume of gas at the portion being increased; whereas such decomposition does not substantially take place at a portion of the gap above the combustion flame. This results in a draft being produced in the gap to cause air in the inner cylindrical member to tend to be introduced via the through-holes of the inner cylindrical member into the portion of the gap above the combustion flame and upward flow, to thereby fail to feed a sufficient or effective amount of air to the combustion flame, leading to incomplete combustion.

On the contrary, in the multi-cylinder combustion structure having a central cylinder arranged inside the inner cylindrical member, the upper portion of the gap between the inner cylindrical member and the outer cylindrical member is fed with air flowing from the interior of the central cylinder to the upper portion of the inner cylindrical member; whereas a combustion flame formed when the wick is lowered to reduce the amount of combustion is fed with air introduced to the gap between the central cylinder and the inner cylindrical member, thus, the combustion flame is fed with air in an amount sufficient to carry out complete combustion irrespective of air flowing above the combustion flame. This ensures complete combustion of the flame even when the combustion operation is carried out while keeping the amount of combustion reduced. Thus, it will be noted that the combustion performance of the multi-cylinder combustion structure including the central cylinder is substantially affected by control of air in the gap between the central cylinder and the inner cylindrical member.

For this purpose, it has been conventionally proposed to incorporate a control member in the combustion structure. For example, Japanese Utility Model Publication No. 73/1955 discloses arrangement of such a control member at each of the upper and lower ends of the central cylinder. Japanese Utility Model Publication No. 3577/1955 discloses arrangement of the control member at the central portion of the central cylinder. Japanese Utility Model Publication No. 32174/1972 discloses mounting of the control member at the lower end of the central cylinder. Finally, Japanese Utility Model Publication No. 35707/1972 discloses arrangement of the control member at the upper end of the central cylinder.

For the same purpose, it is proposed that the central cylinder is provided with small through-holes. For example, the assignee has proposed that the central cylinder be formed at only the lower portion thereof with small through-holes, as disclosed in Japanese Utility Model Publication No. 24347/1979.

In the multi-cylinder combustion structure for outward discharging heat rays from the red-heated inner and outer cylindrical members through the heat-permeable cylinder for heating a room or space, the inner and outer cylindrical members are red-heated by a combustion flame produced therein and combustion gas produced by combustion and heated to a high temperature by heat of the combustion. Unfortunately, the conventional multi-cylinder combustion structure fails to prevent red-heating of the inner and outer cylindrical members from being positionally varied depending upon a positional variation in combustion flame and a variation in flowing of the combustion gas when the wick is lowered to decrease the amount of combustion, although it ensures complete combustion even in the decreased combustion operation as described above. In particular, the red-heated portion of each of the inner and outer cylindrical members is rendered positionally irregular or unstable in the circumferential direction of the cylindrical member. The gap defined between the inner cylindrical member and the outer cylindrical member is formed into an annular shape, so that the conventional combustion structure fails to permit the upper end of the combustion flame produced in the gap when the wick is lowered to be horizontally or circumferentially uniform all over the gap irrespective of ensuring complete combustion. For example, this often causes only one side of the cylindrical member to be red-heated and the other side to be kept dark. Thus, the conventional multi-cylinder combustion structure is obliged to be constructed so as to red-heat the whole inner and outer cylindrical members.

SUMMARY OF THE INVENTION

The present invention has been made in view of the foregoing disadvantage of the prior art.

Accordingly, it is an object of the present invention to provide a multi-cylinder combustion structure for an oil burner which is capable of exhibiting satisfactory aesthetic and handling characteristics irrespective of the amount of combustion.

It is another object of the present invention to provide a multi-cylinder combustion structure for an oil burner which is capable of permitting a portion of the combustion structure red-heated when the amount of combustion is kept at a decreased level to be rendered positionally uniform.

It is another object of the present invention to provide a multi-cylinder combustion structure for an oil burner which is capable of permitting a red-heated section of the combustion structure to be positionally uniformly red-heated even when the amount of combustion is reduced to a degree sufficient to cause the top end of a combustion flame to be positioned in a gap between an outer cylindrical member and an inner cylindrical member.

It is a further object of the present invention to provide a multi-cylinder combustion structure for an oil burner which is capable of being aesthetically satisfactorily red-heated irrespective of the amount of combustion.

It is still another object of the present invention to provide a multi-cylinder combustion structure for an oil burner which is capable of preventing the positional unevenness of upper end of a wick and a variation in size of a gap between an inner cylindrical member and an outer cylindrical member from adversely affecting red-heating of the combustion cylinder.

It is yet another object of the present invention to provide a multi-cylinder combustion structure for an oil burner which is capable of exhibiting good aesthetic characteristics irrespective of the amount of combustion.

It is a still further object of the present invention to provide a multi-cylinder combustion structure for an oil burner which is capable of permitting a red-heated section of the combustion structure to be positionally uniformly red-heated while ensuring complete combustion, even when the amount of combustion is reduced to a degree sufficient to cause the upper end of a combustion flame to be positioned in a gap between an outer cylindrical member and an inner cylindrical member.

It is a yet further object of the present invention to provide a multi-cylinder combustion structure for an oil burner which is capable of positively ensuring red-heating of a double combustion cylinder with a highly simplified construction.

In accordance with the present invention, a multi-cylinder combustion structure for an oil burner is provided. The multi-cylinder combustion structure includes a double combustion cylinder having a red-heated section red-heated by combustion of fuel oil. The double combustion cylinder comprises an inner cylindrical member and an outer cylindrical member which are arranged so as to define an annular gap therebetween. The combustion structure also includes a heat-permeable cylinder arranged outside the double combustion cylinder. The inner cylindrical member is provided at the upper end thereof with a top plate. The combustion structure further includes a partition means mounted on the inner surface of inner cylindrical member and a central cylinder arranged inside the inner cylindrical member in a manner to be concentric with the inner cylindrical member and connected at the upper and lower ends thereof to the top plate of the inner cylindrical member and the partition means, respectively. The central cylinder is provided with a plurality of perforated sections and a plurality of non-perforated sections in a manner to vertically alternate with one another.

In a preferred embodiment of the present invention, the central cylinder is mounted on the partition means.

In a preferred embodiment of the present invention, the perforated and non-perforated sections each are formed into a circumferentially-extending strip-like shape.

In a preferred embodiment of the present invention, the central cylinder is formed into a length corresponding to a red-heated section of the inner cylindrical member and arranged so as to positionally correspond to the inner cylindrical member.

In a preferred embodiment of the present invention, the perforated sections and non-perforated sections are arranged over the whole length of the central cylinder.

In a preferred embodiment of the present invention, the central cylinder is provided at the upper end thereof with one of the perforated sections and at the lower end thereof with one of the non-perforated section.

In a preferred embodiment of the present invention, the non-perforated section provided at the lower end of the central cylinder is circumferentially formed with a row of through-holes smaller than through-holes of the perforated section.

In a preferred embodiment of the present invention, the perforated section is formed into substantially the same width as the non-perforated section. Alternatively, the perforated section is formed into a width somewhat smaller than the non-perforated section.

In a preferred embodiment of the present invention, the perforated section has a plurality of through-holes arranged in a plurality of rows.

DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a multi-cylinder combustion structure for an oil burner according to the present invention will be described hereinafter with reference to the accompanying drawings.

Figure 1:
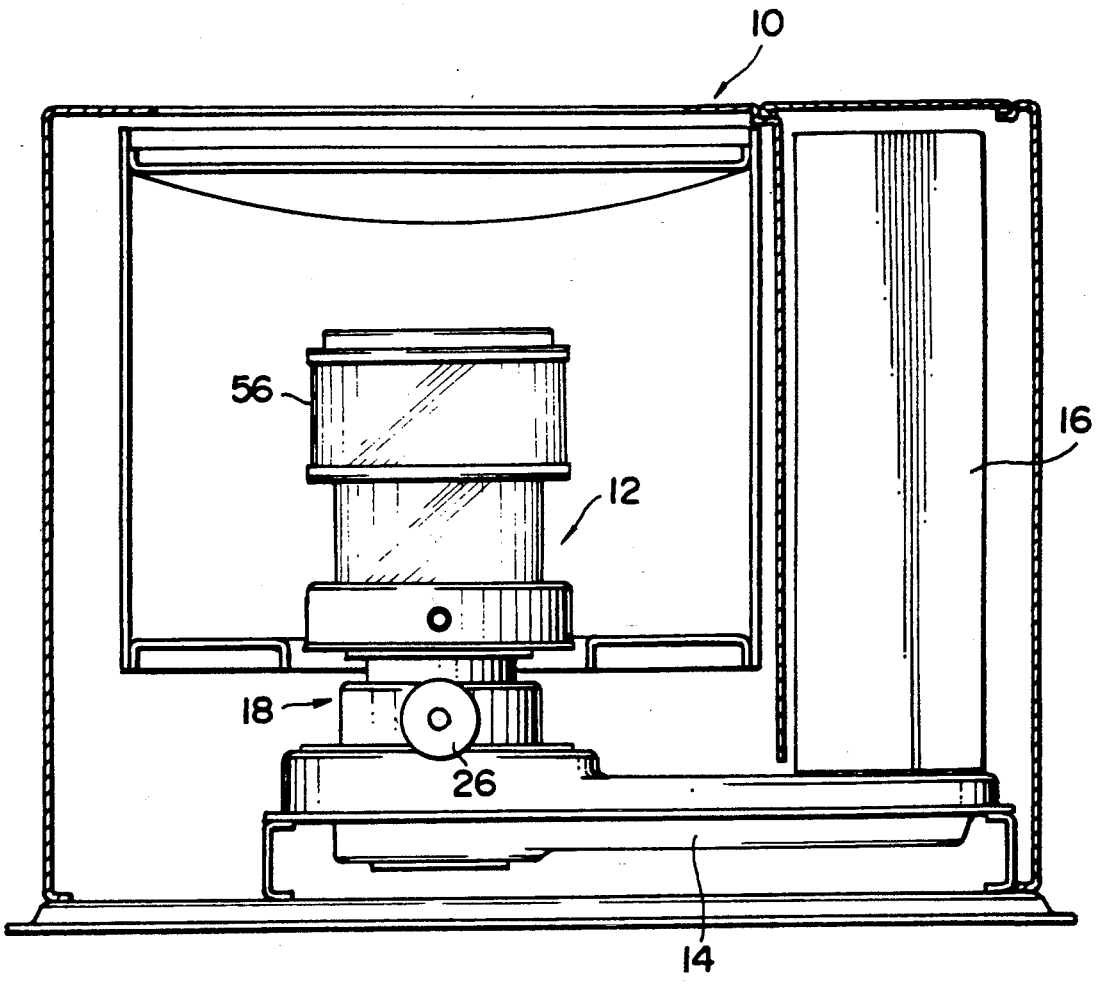
FIG. 1 is a vertical sectional view showing an example of an oil burner in which a multi-cylinder combustion structure of the present invention may be incorporated.

FIG. 1 illustrates an example of an oil burner to which a multi-cylinder combustion structure of the present invention may be applied. In FIG. 1, an oil burner and a multi-cylinder combustion structure are generally designated at reference numeral 10 and 12, respectively. The oil burner shown in FIG. 1 is constructed in the form of a space heater. However, an oil burner to which the present invention is applied is not limited to a space heater.

Figure 2:
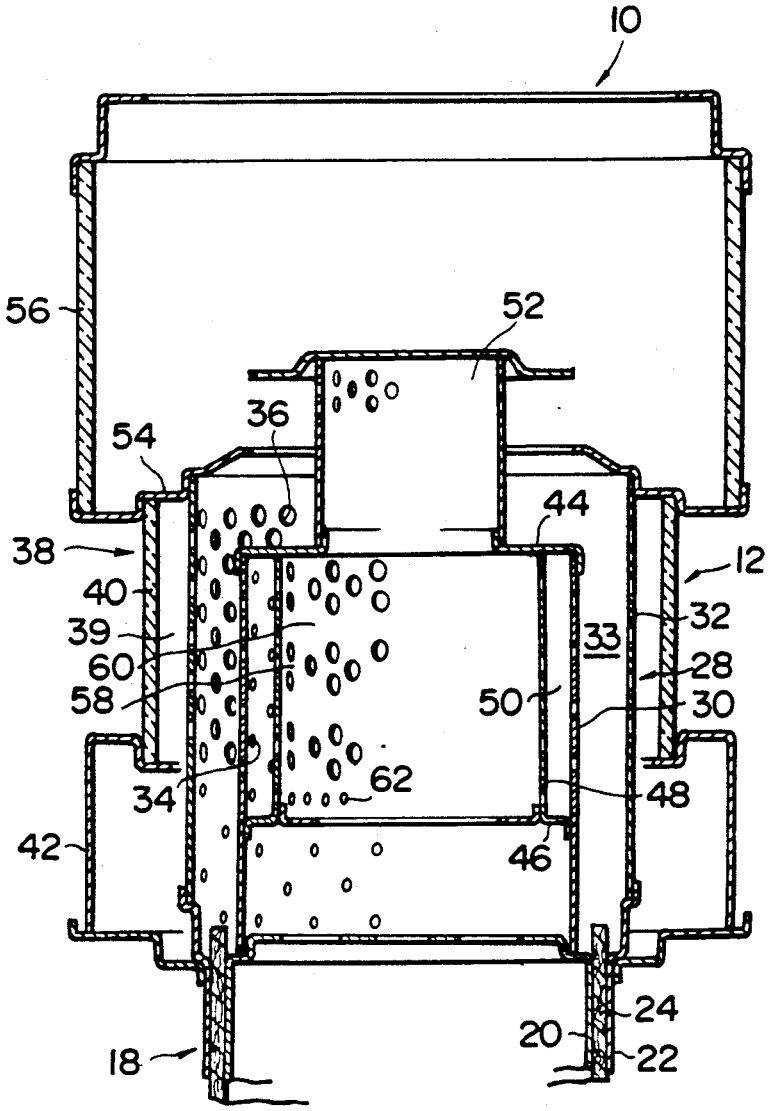
FIG. 2 is a vertical sectional view showing an embodiment of a multi-cylinder combustion structure for an oil burner according to the present invention.

The oil burner 10 shown in FIG. 1 may be constructed in such a manner as widely known in the art, except the multi-cylinder combustion structure 12. The oil burner 10 includes an oil reservoir 14 for storing fuel oil such as kerosene therein for combustion. To the oil reservoir 14 is fed fuel oil from an oil tank 16. The oil burner 10 also includes a wick receiving structure 18, which includes an inner cylinder 20 and an outer cylinder 22 concentrically arranged so as to define an annular space for receiving a wick 24 therein, as shown in FIG. 2. In the wick receiving structure 18 is provided a wick actuating mechanism (not shown), which functions to vertically move the wick 24 for the combustion and fire-extinguishing operations and the combustion adjusting operation. The wick 22 is actuated through the wick actuating mechanism by turning a knob 26.

The multi-cylinder combustion structure 12 of the illustrated embodiment is arranged on the wick receiving structure 18 and includes a double combustion cylinder 28 which comprises an inner cylindrical member 30 and an outer cylindrical member 30 provided outside the inner cylindrical member 30 so as to be concentric with the inner cylindrical member 28 with an annular gap 33 being defined therebetween. The inner and outer cylindrical members 30 and 32 are made of a heat-resistant material such as ceramic. The inner cylindrical member 30 is formed with a plurality of small through-holes 34 and the outer cylindrical member 32 is formed with a plurality of through-holes 36. For the sake of brevity, FIG. 2 shows that the through-holes 34 and 36 each are arranged at a part of each of the inner and outer cylindrical members 30 and 32. However, they are actually provided at the whole inner and outer cylindrical members 30 and 32. The inner and outer cylindrical members 30 and 32 are arranged on the inner and outer cylinders 20 and 22 of the wick receiving structure 18, respectively.

The multi-cylinder combustion structure 12 also includes a heat-permeable cylinder 38 which is made of a heat-resistance permeable material such as heat-resistant glass or the like and arranged outside the outer cylindrical member 32 to outward discharge therethrough heat rays emitted from the inner and outer cylindrical members 30 and 32 red-heated by combustion of fuel oil in the structure 12. The heat-permeable cylinder 38 may be arranged in a manner to be substantially concentric with the outer cylindrical member 32, resulting in an annular gap 39 being defined therebetween. In the illustrated embodiment, the outermost heat-permeable cylinder 38 comprises a heat-permeable cylinder section 40 provided so as to surround an upper red-heated section of each of the inner and outer cylindrical members 30 and 32 red-heated by combustion of fuel oil in the structure 12 and a heat-impermeable cylinder section 42 which is provided on the wick receiving structure 18 so as to support the heat-permeable cylinder section 40 thereon and surround a lower non-red-heated section of each of the inner and outer cylindrical members 30 and 32 which is not red-heated during the combustion operation.

The inner cylindrical member 30 is so constructed that its upper end terminates below the upper end of the outer cylindrical member 32. On the upper end of the inner cylindrical member 30 is mounted an annular top plate 44 so as to inward extend therefrom. Also, the inner cylindrical member 30 is provided on the inner surface of the lower section thereof with an annular partition 46 in a manner to inward extend therefrom.

The multi-cylinder combustion structure 12 further includes a central cylinder 48 concentrically arranged inside the inner cylindrical member 30 so as to define an annular gap 50 therebetween. The central cylinder 48 may be connected at the upper end thereof to the top plate 44 of the inner cylindrical member 30 and the lower end thereof to the partition 46. In the illustrated embodiment, the central cylinder 48 is mounted at the lower end thereof on the inner end of the annular partition 46, so that the annular gap 50 between the central cylinder 48 and the inner cylindrical member 30 may be kept uniform through the partition 46.

Reference numeral 52 designates a flame spreading means arranged above the top plate 44 of the inner cylindrical member 30 so as to act as an afterburner. The outer cylindrical member 32 is provided on the upper end thereof with an annular top plate 54 in a manner to outward extend at the outer end thereof therefrom to close the annular gap 39 between the outer cylindrical member 32 and the heat-permeable cylinder 38. Reference numeral 56 designates an uppermost cylinder supported on the top plate 54 of the outer cylindrical member 32 so as to define an afterburning chamber therein. The cylinder 56 may comprise a heat-permeable cylinder.

Fuel oil fed from the oil tank 16 to the oil reservoir 14 is sucked up by the wick 24 and then ignited through the distal end of the wick 24, so that combustion of the fuel oil starts in the gap 33 between the inner cylindrical member 30 and the outer cylindrical member 32 using air fed thereto via the through-holes 34 and 36 of the cylindrical members 30 and 32. Combustible gas which is produced by thermal decomposition of fuel oil by heat of combustion but upward discharged through the gap 33 between the outer cylindrical member 32 and the inner cylindrical member 30 to the afterburning chamber without being burned in the gap 33 is afterburned through the flame spreading means 52.

The central cylinder 48 is provided with a plurality of circumferentially-extending strip-like perforated sections 58 and a plurality of circumferentially-extending strip-like non-perforated sections 60 in a manner to be alternately arranged in the vertical direction of the central cylinder 48, as shown in FIG. 2. The perforated sections 58 each are formed with a plurality of through-holes over the whole circumference, although FIG. 2 shows that the through-holes are formed at a part of each of the perforated sections 58 for the sake of brevity. Such construction of the central cylinder 48 permits air controlled through the central cylinder 48 and the perforated sections 58 to be fed via the through-holes 34 of the inner cylindrical member 30 to the gap 33 between the outer cylindrical member 32 and the inner cylindrical member 30 to promote combustion in the gap 33, there thereby positionally uniformly red-head both cylindrical members 30 and 32 even when the wick is lowered to decrease the amount of combustion to a degree sufficient to cause the upper end of a combustion flame to be positioned in the gap 33 between the inner cylindrical member 30 and the outer cylindrical member 32.

In the illustrated embodiment, the through-hole of each of the perforated sections 58 are arranged in a plurality of rows. The central cylinder 48 is formed into a length or height substantially corresponding to the red-heated section of the inner cylindrical member 30 and arranged so as to positionally correspond to or be opposite to the member 30. Also, in the illustrated embodiment, the perforated sections 58 and non-perforated sections 60 are vertically alternately arranged over the whole length or height of the central cylinder 48 in such a manner that one of the perforated sections 58 is positioned at the upper end of the central cylinder 48 and one of the non-perforated sections 60 is positioned at the lower end of the cylinder 48. The lowermost non-perforated section 60 may be circumferentially formed with a row of through-holes 62 smaller than the through-holes of the perforated section 58. Also, the perforated section may be formed into substantially the same width as the non-perforated section 60. Alternatively, the former may be formed into a width somewhat smaller than the latter.

Now, the manner of operation of the multi-cylinder combustion structure of the illustrated embodiment constructed as described above will be described hereinafter.

When the wick 24 wetted with fuel oil sucked up from the oil reservoir 14 is raised to an ignition position in the lower portion of the gap 33 between the inner cylindrical member 30 and the outer cylindrical member 32 and then ignited, a draft is produced in the gap 33, to thereby cause air for combustion to be fed via the through-holes 36 (38) of the lower portion of each of the inner and outer cylindrical members 30 and 32, resulting in fuel oil vaporized from the wick being burned to form a combustion flame int he double combustion cylinder 28. This causes the red-heated section of each of the inner and outer cylindrical members 30 and 32 positionally corresponding to the heat-permeable cylinder section 40 of the heat-permeable cylinder 38 to be red-heated to emit heat rays for heating a space or room.

When the wick is lowered to decrease the amount of combustion to a degree sufficient to cause the top end of the combustion flame to be positioned int he gap 33 or the combustion flange is so varied that the upper end thereof is lowered from a position in the outer cylindrical member 32 and above the inner cylindrical member 30 into the gap 33 between the inner cylindrical member 30 and the outer cylindrical member 32, the red-heated section is rendered partially red-heated.

The central cylinder 48 provided inside the inner cylindrical member is arranged between the top plate 44 of the inner cylindrical member 30 and the partition 46 and provided with a plurality of the perforated sections 58 in so as to vertically alternate with the non-perforated sections 60, so that air introduced via the through-holes of the perforated sections 58 of the central cylinder 48 int the gap 50 between the inner cylindrical member 30 and the central cylinder 48 is used as air to be fed via the through-hole 34 of the inner cylindrical member 30 to the gap 33 between both cylindrical members 30 and 32.

When the upper end of the combustion flame is caused to be positioned in the gap between the inner cylindrical member 30 and the outer cylindrical member 32 as described above, fuel oil gas of a high molecular weight vaporized from the wick is thermally decomposed into combustible gas of low molecular weights at a portion of the gap 33 at which the combustion flame exists by heat of the combustion flame, resulting in the volume of gas being increased at the portion; whereas such an increase in volume of gas does not occur at a portion of the gap 33 above the combustion flame. This results in a draft being produced in the gap 33 to a degree sufficient to cause air and gas to upward flow toward the portion of the gap above the combustion flame.

In the illustrated embodiment, the central cylinder 48 is provided a plurality of the through-holes because the strip-like perforated sections 58 are arranged so as to alternate with the strip-like non-perforated sections 60. Such construction of the central cylinder 48 ensures to permit air fed from the interior of the central cylinder 48 through the perforated sections 58 of the central cylinder 48 to the gap 50 between the inner cylindrical member 30 and the central cylinder 48 to upward flow in the gap 50 and then enter the gap 33 between the inner cylindrical member 30 and the outer cylindrical member 32 via the through-holes 34 of the inner cylindrical member 30. Thus, the portion of the gap 33 above the combustion flame formed when the wick is lowered to reduce the amount of combustion may be effectively supplied with air from the interior of the central cylinder 48, to thereby prevent air fed to the portion of the gap above the combustion flame from adversely affecting supply of air to the portion of the gap in which the combustion flame exists, resulting in the flame being subject to complete combustion.

Thus, the arrangement of the central cylinder permits complete combustion to be ensured as in the prior art, even when the wick is lowered to cause the upper end of a combustion flame to be positioned in the gap 33.

As described above, the conventional combustion structure fails to permit the upper end of the combustion flame positioned in the gap when the wick is lowered for reducing the amount of combustion to be horizontally for circumferentially uniform all over the gap irrespective of ensuring complete combustion. The red-heating of the inner and outer cylindrical members, as described above, is carried out by the combustion flame as well as combustion gas of an elevated temperature produced by combustion, so that a variation in height of the combustion flame formed in the gap causes red-heating of the red-heated section of each of the inner and outer cylindrical members to be positionally varied, so that a part of the red-heated section is rendered positionally irregularly red-heated and the remaining part of the red-heated section is rendered positionally irregularly dark, resulting in s user misunderstanding that the combustion structure carrying out incomplete combustion at places although it actually accomplishes complete combustion.

The multi-cylinder combustion structure of the illustrated embodiment, as described above, is so constructed that the central cylinder 48, as described above, is provided with a plurality of the strip-like perforated sections 58, which are arranged so as to vertically alternate with the strip-like non-perforated sections 60. Such construction permits a large amount of air for combustion to be upward fed from the interior of the central cylinder 48 through the perforated sections 58 of the central cylinder 48 and the through-holes 34 of the inner cylindrical member 30 positionally corresponding to the perforated sections 58 to the gap 33 between the inner cylindrical member 30 and the outer cylindrical member 32. Also, it permits feeding of air via the through-holes 34 of the inner cylindrical member 30 positionally corresponding to the non-perforated sections 60 to the gap 33 to be restricted. This causes combustion carried out when the upper end of the combustion flame is positioned in the gap 33 to be not only promoted at portions of the gap 33 positionally corresponding to the perforated sections 58 because of a sufficient amount of air fed thereto, resulting in the combustion flame being decreased in height at the portions, but restricted at portions of the gaps 33 positionally corresponding to the non-perforated sections 60 because of a failure in feeding of a sufficient amount of air, resulting in the combustion flame being increased in height at the portions, so that the upper end of the whole combustion flame are rendered positionally uniform in the circumferential direction of the gap 33.

Further, a plurality of the perforated sections 58 are arranged so as to vertically alternate with the non-perforated sections 60; therefore, the combustion flame formed when the wick is lowered to cause the upper end of the flame to be positioned in the gap 33 is rendered uniform at the portions thereof corresponding to the perforated and non-perforated sections of the central cylinder 48, so that the upper portion of the red-heated section at which the combustion flame does not exist is rendered uniformly dark and the lower portion of the red-heated section at which the combustion flame exists is rendered uniformly red-heated while ensuring that the boundary between both portions is circumferentially or horizontally uniformly defined, to thereby improve the aesthetic property of the red-heated section of the double combustion cylinder 28.

As can be seen from the foregoing, the multi-cylinder combustion structure of the present invention is so constructed that the central cylinder is provided with a plurality of the perforated sections and a plurality of the non-perforated sections in a manner to vertically alternate with one another. Therefore, even when the wick is lowered to decrease the amount of combustion to a degree sufficient to cause the upper end of the combustion flame to be positioned in the gap between the inner cylindrical member and the outer cylindrical member, the combustion structure permits the re-heated section of the double combustion cylinder to be positionally uniformly red-heated while ensuring complete combustion in a manner to cause the upper portion of the red-heated section to be uniformly dark and the lower portion of the red-heated section to be uniformly red-heated while ensuring that the boundary between both portions is circumferentially or horizontally uniformly defined. Thus, the present invention exhibits satisfactory aesthetic and handling characteristics irrespective of the amount of combustion.

While a preferred embodiment of the invention has been described with a certain degree of particularity with reference to the drawings, obvious modifications and variation are possible in light of the above teaching. It is therefore to be understood that within the scope of the appended claims, the invention may be practiced otherwise than as specifically described.

What is claimed is:

1. A multi-cylinder combustion structure for an oil burner comprising:

a double combustion cylinder including a red-heated section red-headed by combustion of fuel oil, said double combustion cylinder comprising an inner cylindrical member and an outer cylindrical member which are arranged so as to define an annular gap therebetween, and said inner cylindrical member being provided at the upper end thereof with a top plate;

a heat-permeable cylinder arranged outside said double combustion cylinder;

a partition means mounted on the inner surface of said inner cylindrical member; and, a central cylinder arranged inside said inner cylindrical member in such a manner as to be connected at the upper and lower ends thereof to said top plate to said inner cylindrical member and to said partition means, respectively;

said partition means comprising a partition arranged between the lower end of said central cylinder and said inner cylindrical member so as to close a lower end of a gap between said central cylinder and said inner cylindrical member;

and said central cylinder being provided with a plurality of perforated sections and a plurality of non-perforated sections in a manner to vertically alternate with one another.

2. A multi-cylinder combustion structure as defined in claim 1, wherein said central cylinder is mounted on the partition of said partition means.

3. A multi-cylinder combustion structure as defined in claim 1, wherein each of said perforated and nonperforated sections is formed into a circumferentially-extending strip-like shape.

4. A multi-cylinder combustion structure as defined in claim 1, wherein said central cylinder has a length which corresponds to a red-heated section of said inner cylindrical member and is arranged opposite to said inner cylindrical member.

5. A multi-cylinder combustion structure as defined in claim 1, wherein said perforated sections and non-perforated sections are arranged over the whole length of said central cylinder.

6. A multi-cylinder combustion structure as defined in claim 1, wherein said central cylinder is provided at the upper end thereof with one of said perforated sections and at the lower end thereof with one of said non-perforated sections.

7. A multi-cylinder combustion structure as defined in claim 1, wherein said non-perforated section provided at the lower end of said central cylinder includes a portion circumferentially formed with a row of through-holes smaller than through-holes of said perforated section.

8. A multi-cylinder combustion structure as defined in claim 1, wherein said perforated sections have substantially the same width as said non-perforated sections.

9. A multi-cylinder combustion structure as defined in claim 1, wherein said perforated sections have a width somewhat smaller than that of said non-perforated sections.

10. A multi-cylinder combustion structure as defined in claim 1, wherein said perforated sections have a plurality of through-holes arranged in a plurality of rows.

* * * * *

UNITED STATES PATENT AND TRADEMARK OFFICE

CERTIFICATE OF CORRECTION

PATENT NO. : 5,169,306

DATED : December 8, 1992

INVENTOR(S) : Toru Nakagaito

It is certified that error appears in the above-identified patent and that said Letters Patent is hereby corrected as shown below:

Column 10, line 49, change the first occurrence of "to" to --of--.

Column 11, line 14, Change "1" to --6--.

Signed and Sealed this

Nineteenth Day of October, 1993

*Attest:*

*Attesting Officer*

BRUCE LEHMAN

*Commissioner of Patents and Trademarks*